US006185885B1

(12) United States Patent
Thaler

(10) Patent No.: US 6,185,885 B1
(45) Date of Patent: Feb. 13, 2001

(54) ROOF FLASHING ASSEMBLY

(76) Inventor: Ken Thaler, 127 Hardie Road, R.R. # 1, Parry Sound, Ontario (CA), P2A 2W7

( * ) Notice: Under 35 U.S.C. 154(b), the term of this patent shall be extended for 0 days.

(21) Appl. No.: 09/227,662

(22) Filed: Jan. 8, 1999

(51) Int. Cl.[7] ..... E04D 13/14

(52) U.S. Cl. ..... 52/219; 52/58; 52/199; 285/42

(58) Field of Search ..... 52/58–62, 198, 52/199, 218, 219, 302.6, 302.7; 285/3–4, 42–44

(56) References Cited

U.S. PATENT DOCUMENTS

| | | | | |
|---|---|---|---|---|
| 1,282,535 | * | 10/1918 | Bropson | 52/199 |
| 1,931,066 | * | 10/1933 | Eckert | 52/302.1 |
| 2,985,465 | | 5/1961 | Church . | |
| 3,593,478 | * | 7/1971 | Mason | 52/302.1 |
| 3,797,181 | * | 3/1974 | Nievelt | 52/199 |
| 4,010,578 | | 3/1977 | Logsdon . | |
| 4,265,058 | | 5/1981 | Logsdon . | |
| 4,442,643 | * | 4/1984 | Stadheim | 52/199 X |
| 4,652,321 | * | 3/1987 | Greko | 52/58 X |
| 4,730,421 | * | 3/1988 | Leeland | 52/58 |
| 5,226,263 | * | 7/1993 | Merrin et al. | 52/58 |
| 5,237,789 | | 8/1993 | Thaler . | |
| 5,802,787 | | 9/1998 | Thaler . | |

OTHER PUBLICATIONS

Thaler Metal Industries Inc., Catalogue Sheet—STACK JACK™ Flashings Detail A–11, Jul. 1997.

* cited by examiner

*Primary Examiner*—Carl D. Friedman
*Assistant Examiner*—Winnie Yip
(74) *Attorney, Agent, or Firm*—Mark Kusner

(57) ABSTRACT

A roof flashing assembly is disclosed, comprising a body member having a base portion, adapted to be rigidly sealingly mountable upon a roof surface in surrounding relation to projection therefrom, a boss portion extending from the base portion, having an inner boss surface which defines a passageway, extending through the boss portion, and adapted to receive an elongate member extending upwardly from the roof, an annular resilient gasket, having circumferentially extending first, second and third upper surface contours. The first contour defines a sealing surface adapted for resilient sealing contact with an outer surface of the elongate member at a location axially adjacent said base portion. The second contour defines a concave body portion, and the third contour defines a mounting surface which is rigidly sealingly mounted to the inner boss surface. A means for directing moisture way, preferably a resilient grommet, comprising an annular grommet body, having a groove extending circumferentially around same. The grommet is assembled on an upper end of the boss portion with the groove in resilient sealing engagement with an annular flange portion of the body member and having three inwardly tapered circumferentially extending lips positioned on an interior surface of the grommet surface and extending inwardly adjacent a top surface of the grommet body. The lips are disposed in downwardly and outwardly stepped relation, having internal diameters of downwardly increasing magnitude and being adapted to resiliently sealing receive said outer surface of the elongate member at a location axially spaced from the base portion.

15 Claims, 5 Drawing Sheets

ROOF FLASHING ASSEMBLY

FIELD OF THE INVENTION

The present invention relates to the field of roof flashings, and more particularly, to roof flashings of the type which provide a waterproof and weather resistant seal between a roof of a building structure and pipes, vent stacks, support members for roof mounted apparatus, or other elongate members projecting from the roof.

BACKGROUND OF THE INVENTION

Roof flashing is conventionally used to provide a waterproof and weather resistant seal around pipes, vent stacks and other elongate members projecting from roofs. The flashing is generally constructed from sheet metal, flexible moulded rubber or other synthetic material formed in an appropriate shape to encircle such projecting members, and is normally made to extend slightly above the level of the roof, to limit the infiltration of precipitation. In flat roofs, where it is possible that standing water might accumulate, this is particularly important. In some applications, including exhaust vent stacks, cap members are mounted on top of the roof flashing and vent stack. In other applications, including support members for roof mounted apparatus, it is critical to provide a long lasting, water tight seal of any gap that exists between the flashing and the projecting member. Commonly, such gaps are sealed by caulking with resilient materials, such as silicon.

Caulking is generally effective in this use. However, the use of caulking requires that close tolerances be maintained to ensure that the gap to be sealed is sufficiently narrow for a caulk seal to be established. Thus, where vent pipes or stacks of differing outside diameters are to be utilized, different flashings matching the differing vent pipes or stacks must be purchased and installed. The requirement for matching flashings also makes it difficult to accommodate modifications to designs made during construction, which often occur. Equally problematic is the gradual and often eventual breakdown of the integrity of the caulking seal caused by movement of the roof flashing and stack members due to expansion and contraction of their components because of seasonal temperature fluctuations. Further, caulking can be difficult to work with, can have a limited effective lifetime, and can be expensive. Moreover, its installation is labour intensive.

It is known in the prior art for grommet seals to be utilized to seal gaps between pipes or stacks and flashing, instead of caulking. An example of a grommet seal for use with a roof flashing is found in U.S. Pat. No. 5,802,787, issued Sep. 8, 1998, to Kenneth Thaler, which patent is directed to a resilient grommet for forming a flexible seal between a roof flashing and a co-axially disposed elongate member, and is incorporated herein by reference. The resilient grommet therein described forms a mushroom shaped head on the top of the flashing to effectively shed precipitation and avoid accumulation or pooling of water and ice on the flashing. The bottom portion of the grommet provides a rounded edge to collect-form droplets, which are quickly shed from the assembly. The grommet is formed of homogenous elastomeric material which resiliently surrounds an outwardly extending flange on the flashing. The resilient grommet is stretched over the flange and snaps back into its original shape when installed. The grommet is easily properly positioned on the flange during installation and is not easily dislodged, due to its resilience and its close fitting engagement with the flange.

It is evident that the use of resilient grommets has advantages over the use of caulking in the sealing of gaps between flashing and elongate members, such as vent pipes or stacks. Firstly, a variety of grommets can be produced, each adapted to fit a common flashing, but having varying internal diameters, to seal against vent pipes or stacks of differing external diameters. This allows for common flashings to be utilized during construction, cutting down on cost and waste, and also allows for convenient changes to the vent pipes or stacks during construction. Similarly, where final designs have not yet been made, the use of grommets as described allows a flashing to be mounted, and the roof sealed therearound, while final design decisions are made, with confidence that it will not be necessary to replace the flashing and reseal the roof if a vent pipe or stack of a different diameter than that which was expected is ultimately determined to be utilized. Such a feature has benefits, in that certain construction trades, such as drywallers and painters, normally can not proceed until the roof of a structure has been sealed, and might otherwise be required to postpone their activity, slowing down the overall pace of construction, and adding to costs.

However, known prior art roof flashing constructions suffer from a susceptibility to the build up of condensation within the flashing. This may even be exacerbated in roof flashing assemblies having resilient grommet seals. In known prior art roof flashing constructions, an air space is created between the outer surface of the elongate member and the interior surface of the flashing member, which air space is in liquid communication with the inside atmosphere of the structure. This allows moisture in warm air from within the structure to collect, condense and freeze within the flashing during winter months, which collected moisture melts during the spring, eventually leaking into the structure. Because the use of a grommet seal allows for the gap between the elongate member and the inner surface of the flashing to be wider than that which can be accommodated by silicon caulking, a greater volume of frozen moisture may accumulate in such a construction, and in many instances where grommet seals are utilized, the amount of moisture entering the structure in the spring is sufficient to cause the occupants of the building to incorrectly assume that the grommet seal is leaking, resulting in unnecessary roof repairs and an industry perception that grommet seals are unreliable.

In an attempt to alleviate water infiltration into the interior of a building due to condensation, insulation is typically applied to the inside surface of the flashing. Despite the availability of insulated roof flashings, many installers elect, because of cost, to use non-insulated flashings. However, even when insulation is used, it has been found that condensation problems will still persist to an unacceptable degree.

SUMMARY OF THE INVENTION

It is an object of the present invention to overcome, inter alia, the shortcomings of the prior art described above by providing a roof flashing assembly that is economical to purchase and install, that provides a long lasting water tight seal between a roof and a member projecting from the roof, that allows for convenient modifications during construction and that does not suffer from a susceptibility to the build up of condensation within the roof flashing. In the case of some roof flashing assemblies made in accordance with this invention, the insulation typically applied to the inside surface of the flashing is no longer necessary.

These and other objects are addressed by the present invention, a roof flashing assembly which provides a seal between an upper roof surface of a roof structure and an elongate member of substantially constant cross-section axially extending substantially vertically upwardly above said roof surface to a projecting end of said elongate member.

According to one aspect of the invention, the roof flashing assembly comprises a body member which body member itself comprises a base portion and a boss portion. The base portion is adapted to be rigidly sealingly mountable upon said roof surface in surrounding relation to said elongate member, with the boss portion axially extending from said base portion to an upper end of the boss portion. The boss portion has an inner boss surface, which inner boss surface defines a passageway extending through the boss portion which is adapted to receive therethrough said elongate member when the base portion is operatively mounted upon said roof surface. There is also provided a means for directing moisture away from a first end of a gap defined between an outer perimeter surface of said elongate member and the inner boss surface, at a location axially spaced from the base portion, and a sealing means for resiliently sealing a second end of said gap at a location axially adjacent to the base portion, when the base portion is operatively mounted upon said roof surface.

According to other aspects of the invention, the boss portion is preferably annular, with the passageway defined by the inner boss surface being substantially cylindrical, and the base portion is preferably annular and coaxial with the boss portion.

According to another aspect of the invention, the sealing means preferably is an annular resilient gasket, having a substantially flat lower surface, with an inner perimeter and an outer perimeter thereof, and having circumferentially extending first, second and third upper surface contours. The first contour defines a sealing surface which commences at the inner perimeter of the lower surface, and extends therefrom in an upwardly directed arc, first inwardly, thence outwardly, to a first terminus, which sealing surface is adapted to resiliently sealingly contact against said outer perimeter surface of said elongate member at said location axially adjacent said base portion, when the base portion is operatively mounted upon said upper roof surface. The second contour defines a concave body portion of the resilient gasket which commences at the first terminus, extends therefrom, initially, radially outwardly, thence, in an upwardly and outwardly directed arc, to a second terminus. The third contour defines a mounting surface, commencing at the second terminus and extending in a downwardly and outwardly directed arc to the outer perimeter, which mounting surface is rigidly sealingly mounted to said inner boss surface.

According to yet another aspect of the invention, the means for directing moisture away preferably is a resilient grommet, comprising an annular grommet body and a sealing lip means. The annular grommet body has a groove extending circumferentially around an outer base surface thereof, and an interior grommet surface. The grommet is assembled on said upper end of the boss portion, with the groove in resilient sealing engagement with the annular flange portion of the roof flashing member. The sealing lip means positioned on said interior grommet surface, extending inwardly adjacent a top surface of the grommet body, are adapted to resiliently sealing receive said outer perimeter surface of the elongate member at said location axially spaced from the base portion, when the base portion is operatively mounted upon said upper roof surface.

According to yet another aspect of the invention, the means for directing moisture away is a cap member. The cap member is rigidly mounted upon the upper end of the boss portion in capped overlying relation to the projecting end of the elongate member and is adapted to overly the projecting end of said elongate member when the base portion is operatively mounted upon said roof surface.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

DETAILED DESCRIPTION OF PREFERRED EMBODIMENTS

Figure 1:
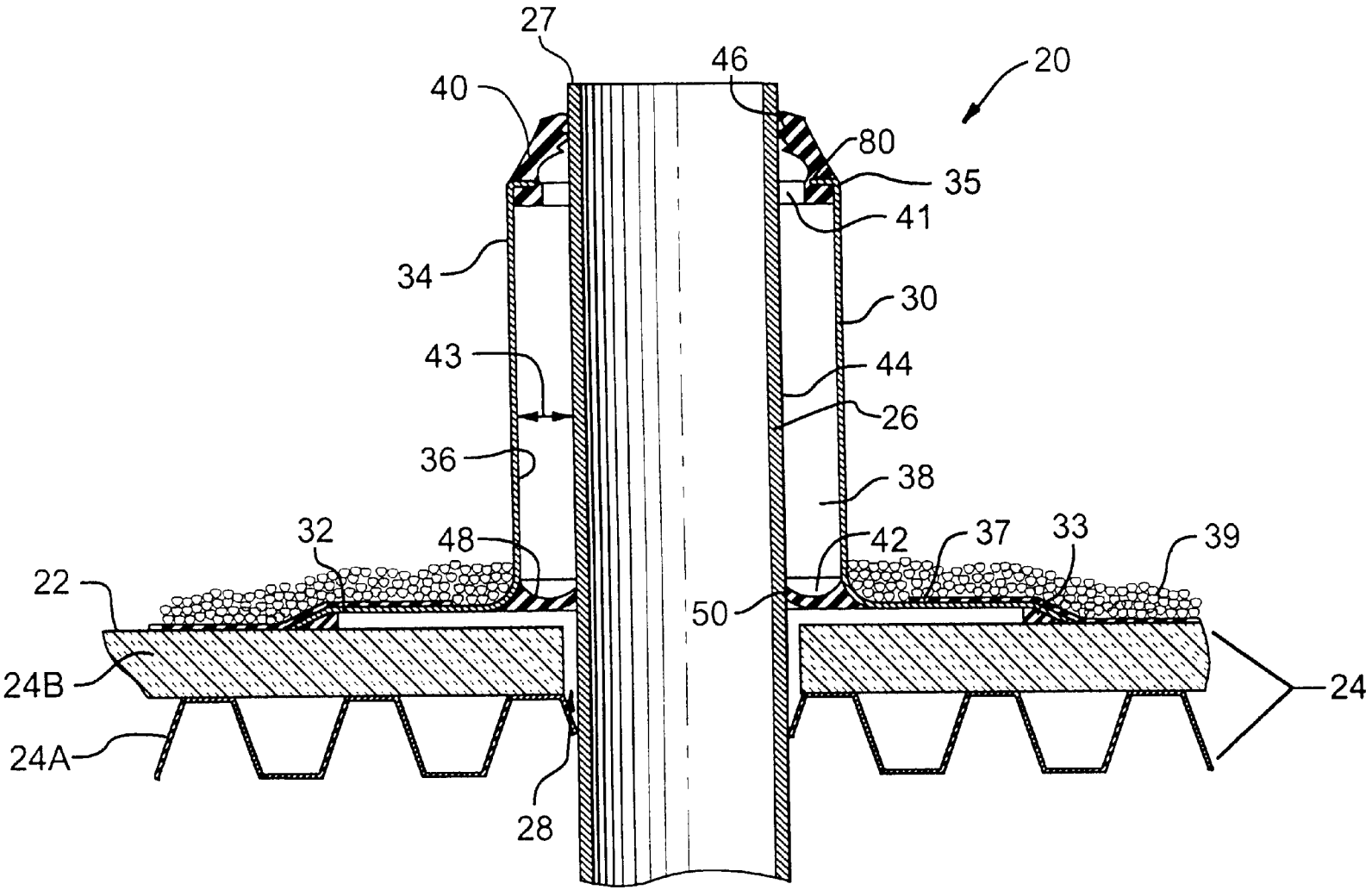
FIG. 1 is a sectional view showing a first embodiment of the roof flashing assembly, according to the present invention.

Referring to the drawings, wherein like numerals are used to designate similar parts through the various views, there is shown a roof structure, generally designated by reference numeral 24 comprising a conventional corrugated roof deck member 24A and a layer of conventional rigid insulation material 24B, the latter layer presenting an upper roof surface 22. An elongate member 26 of substantially constant cross-section axially extends substantially vertically upwardly through a roof opening 28 above the level of the roof surface 22 to a projecting end 27. The shown metal roof construction illustrates one type of roof construction and is used only by way of example. The invention may be used in all manner of roof construction including poured or cast concrete.

The subject matter of this invention is a roof flashing assembly, generally designated by the reference number 20, which assembly 20 provides for sealing between the roof surface 22 and the elongate member 26.

The roof flashing assembly 20 comprises a body member 30, having a base portion 32 adapted to be rigidly sealingly mountable, by conventional mounting means, upon the roof surface 22. The manner of mounting the body member 30 atop the roof surface 22 can include bolts, screws, or the like, in combination with bitumen, or the like, but preferably, the base portion 32 is embedded in a layer 33 of known air-hardening liquid plastic, and thereby rigidly sealingly mounted to the roof surface 22. Conventionally, a water-tight rubberized roofing membrane, or the like 37, is then placed over the roof surface 22, and heat reflective material 39, in the form of pea gravel, or the like, is spread over the roofing membrane 37 as a final roofing step.

It can be seen in FIG. 1 that the body member 30 further comprises a boss portion 34 axially extending from said base portion 32 to an upper end 35 of the boss portion 34, with said boss portion 34 having an inner boss surface 36, which defines a passageway 38. The passageway 38 extends through the boss portion 34 coincident with the axis of the boss portion 34, and is adapted to receive therethrough said elongate member 26, when the base portion 32 is operatively mounted upon the roof surface 22 as aforementioned. When such operative mounting is completed, the longitudinal axes of the boss portion 34, the passageway 38 and the elongate member 26 are preferably substantially coincident.

There is also provided in the present invention, as more fully described in subsequent paragraphs, a means for directing moisture away from a first end 41 of an annular gap, said annular gap being denoted by the double-headed arrow 43 on FIG. 1, defined between an outer perimeter surface 44 of the elongate member 26 and the inner boss surface 36, at a location 46 axially spaced from the base portion 32, and a sealing means 48 for resiliently sealing a second end 42 of said gap 43 at a location 50 axially adjacent to the base portion 32, when the base portion 32 is operatively mounted upon the roof surface 22 as aforementioned.

It can be seen in FIG. 1 that the sealing means 48 preferably is a resilient gasket 48 adapted to resiliently seal the second end 42 of said gap 43 as aforementioned.

Commonly, pipes of substantially circular cross-section are employed as building vents and stacks and supports for roof mounted apparatus. Accordingly, in one embodiment of the present invention, the body member 30 is preferably constructed with the boss portion 34 being annular, with the passageway 38 being substantially cylindrical, and with the base portion 32 being substantially annular and coaxial with the boss portion 34, and incorporating an annular resilient gasket 48 as the sealing means 48. Such shapes are preferred since usage of same minimizes material waste. Furthermore, same are inexpensively manufactured, not requiring folding, welding or complex stamping to produce. However, the roof flashing assembly 20 of the present invention is readily capable of accommodating elongate members having square, rectangular, triangular and other regular cross-sectional shapes, with appropriate modifications to the mating component shapes (not shown).

Figure 2:
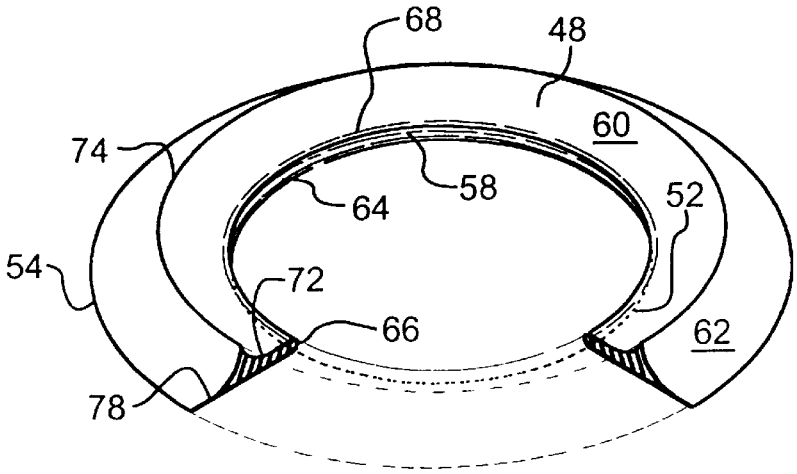
FIG. 2 is a perspective view of the resilient gasket of FIG. 1, shown partially in phantom outline.
Figure 3:
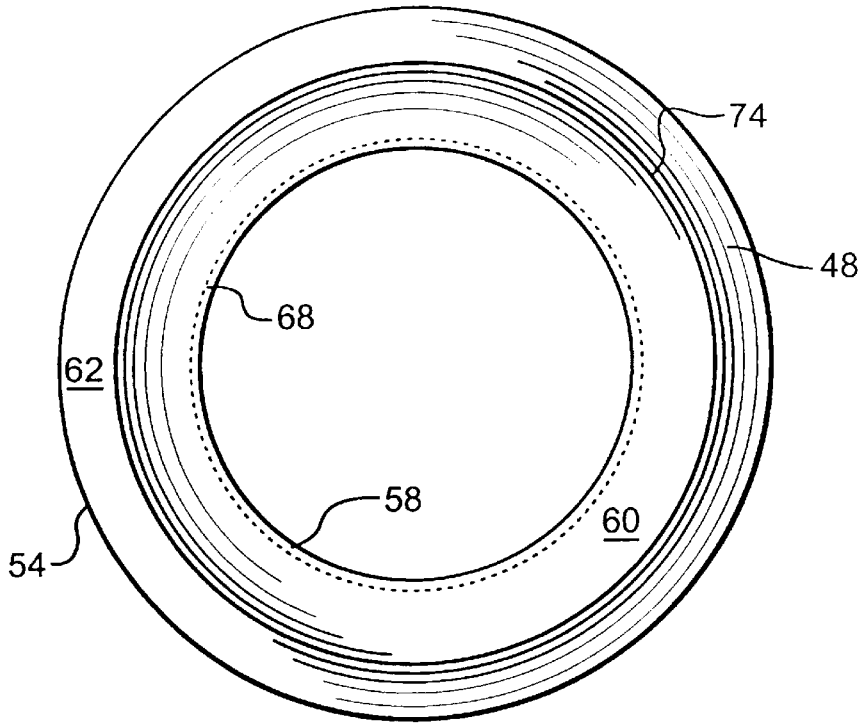
FIG. 3 is a plan view of the resilient gasket of FIG. 2, shown on a larger scale.
Figure 4:
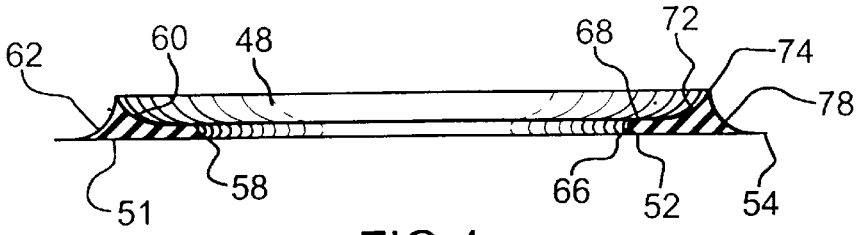
FIG. 4 is a vertical sectional view of the resilient gasket of FIG. 2.

Preferably, the resilient gasket 48 has a substantially flat lower surface 51, with an inner perimeter 52 and an outer perimeter 54 thereof, and has circumferentially extending first 58, second 60 and third 62 upper surface contours, as best seen in FIGS. 2, 3 and 4.

The first contour 58 defines a sealing surface 58 which commences at the inner perimeter 52 of the lower surface 51, and extends therefrom in an upwardly directed arc 66, first inwardly, thence outwardly, to a first terminus 68. The sealing surface 58 is adapted to resiliently sealingly contact against the outer perimeter surface 44 of the elongate member 26 at the aforementioned location 50 axially adjacent the base portion 32, when the base portion 32 is operatively mounted upon the roof surface 22.

The second contour 60 defines a concave body portion 60 of the resilient gasket 48 which commences at the first terminus 68, extends therefrom, initially, radially outwardly, thence, in an upwardly and outwardly directed arc 72, to a second terminus 74. As shown in FIGS. 1, 2, 3, 4 and 6, the mounting surface 62 and concave body portion 60 intersect one another in circular linear fashion at the second terminus 74. However, it must be appreciated that other shapes for the second terminus 74 may be used, such as bull-nose shapes, with similar advantage.

The third contour 62 defines a mounting surface 62, commencing at the second terminus 74 and extending in a downwardly and outwardly directed arc 78 to the outer perimeter 54, which mounting surface 62 is rigidly sealingly mounted to said inner boss surface 36, by known mounting means, such as contact cement. Again, in FIGS. 1, 2, 3, 4 and 6, the mounting surface 62 and lower surface 51 intersect one another in circular linear fashion at the outer perimeter 54, but other shapes for the outer perimeter 54 may be used, such as bull-nose shapes, with similar advantage.

The resilient gasket 48 is capable of being constructed in other shapes than that specifically herein described; for example, in an annular shape, having substantially flat upper and lower surfaces (not shown). However, in the preferred mode of installation, namely, utilizing air-hardened liquid plastic to mount the base portion upon the roof surface, such shapes are not preferred. Although the flat upper surface of such a gasket could be adapted for sealing contact with the base portion of the body member, this would necessarily require that the lower surface of the gasket project downwards, towards the roof surface, when mounted. Consequently, during installation of the body member, measures would need to be taken to ensure that the downwardly projecting lower surface of such a gasket did not become coated in the liquid-plastic material, since this could impact upon the resilience and effectiveness of the seal between the gasket and the elongate member. Alternatively, the lower surface of such a gasket could be adapted for sealing contact with the roof portion itself. However, this adds an additional step to the installation process, and for this reason is also not favoured.

Preferably, the resilient gasket 48 is moulded of homogenous elastomeric material, such as rubber or polyurethane, such materials being relatively inexpensive, easily moulded to the desired shape, and capable of providing long-lasting resilient waterproof and weather resistant seals, with the body member 30, being spun manufactured, from a durable, inexpensive and corrosion-resistant material, such as aluminum. The body member 30 can be manufactured using other methods, such as casting or stamping; however, such means of manufacture are generally more expensive than spinning, and accordingly, are not favoured.

As seen in FIG. 1, the body member 30 further preferably comprises an annular flange portion 80 positioned coaxially with the boss portion 34 and adjacent the upper end 35 thereof, and extending radially inwardly from the inner boss surface 36.

As earlier mentioned, the present invention also comprises a means for directing moisture away 40. In one embodiment shown in FIG. 1, the said means 40 is a resilient grommet. In another embodiment shown in FIG. 7, the said means is a cap member.

Figure 5:
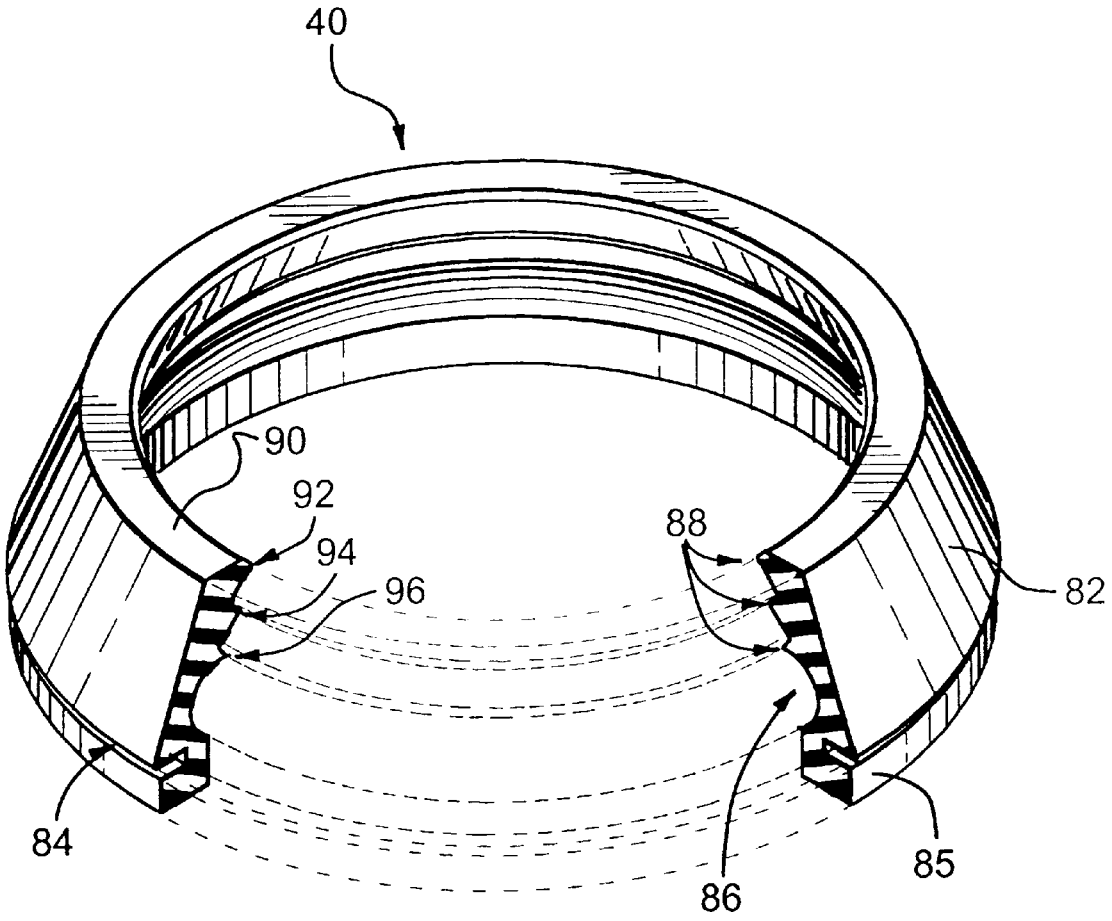
FIG. 5 is a perspective view of the resilient grommet of FIG. 1, shown partially in phantom outline.

As best seen in FIG. 5, the resilient grommet 40 comprises an annular grommet body 82, having a groove 84 extending circumferentially around an outer base surface 85 of the grommet body 82, with said resilient grommet 40 being assembled on the upper end 35 of the boss portion 34 in resilient sealing engagement with the annular flange portion 80 of the body member 30, by means of frictional engagement between said annular flange portion 80 and said groove 84.

The resilient grommet 40 of FIG. 5 further preferably comprises an interior grommet surface 86, with sealing lip means 88 positioned on the interior grommet surface 86, which extend inwardly adjacent a top surface 90 of the grommet body 82, the sealing lip means 88 being adapted to resiliently sealingly receive the outer perimeter surface 44 of the elongate member 26 at the location 46 axially spaced from the base portion 32, when the base portion 32 is operatively mounted upon the roof surface 22.

It can be further seen that the sealing lip means 88 preferably comprises three inwardly tapered circumferentially extending lips 92, 94 and 96 disposed in downwardly outwardly stepped relation coaxial with the boss portion 34, said lips 92, 94 and 96 having internal diameters of downwardly increasing magnitude.

The resilient grommet 40 thus constructed can be easily inserted or replaced by hand at any point during or after installation of the body member 30, and again is constructed of homogenous elastomeric material, such as rubber, neoprene rubber or polyurethane, for reasons of economy and resilient sealing ability.

Figure 6:
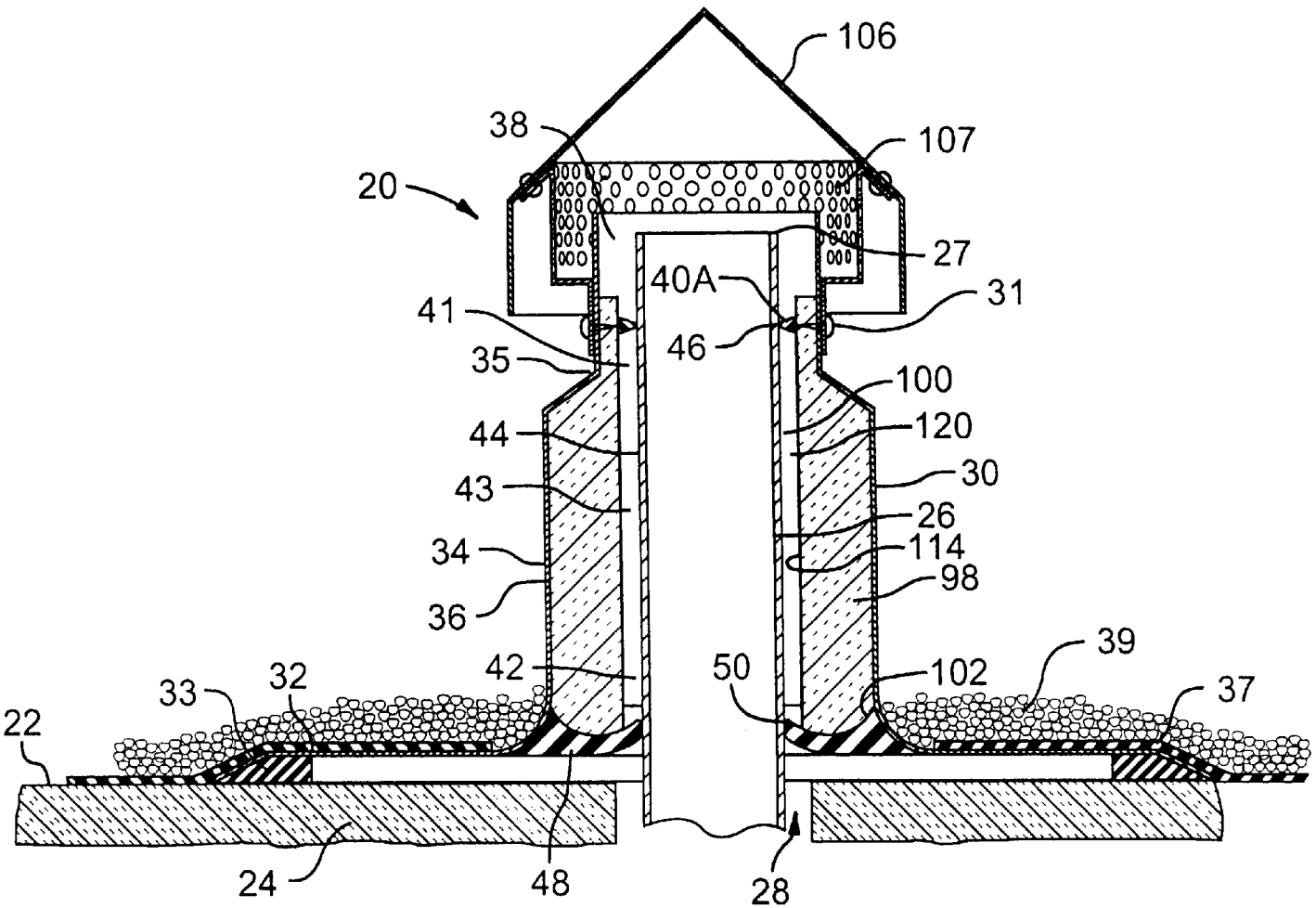
FIG. 6 is a sectional view showing a second embodiment of a roof flashing assembly according to the present invention.

In an alternative embodiment, shown in FIG. 6, the roof flashing assembly 20 further comprises an insulating liner 98 constructed of expanded urethane foam, or the like, positioned within the passageway 38 and being rigidly attached to the body member 30, by known attachment means, such as contact cement, said insulating liner 98 having an axially aligned channel 100 therethrough adapted to receive said elongate member 26 when the base portion 32 is operatively mounted upon the roof surface 22.

It can be further seen that the insulating liner 98 has a lower annular surface 102, which lower annular surface is rigidly sealingly attached to the concave body portion 60 of the resilient gasket 40 by known attachment means, such as contact cement. The insulating liner 98 also has a cylindrical inner liner surface 114.

In the alternative embodiment of FIG. 6, the roof flashing assembly further comprises a cap member 106 rigidly mounted by suitable mounting means, such as screws 31, upon the upper end 35 of the boss portion 34 in capped overlying relation to said upper end 35, which cap member 106 is adapted to overly the projecting end 27 of the elongate member 26, when the base portion 32 is operatively mounted upon the roof surface 22. In this alternative embodiment, there may be provided a bead of silicon caulking 40A sealing an annular space 120 defined by the inner liner surface 114 and the outer perimeter surface 44 of the elongate member 26, at said location 46 axially spaced from the base portion 32. The cap member 106 further comprises a perforated screen 107 rigidly affixed within the cap member by known affixing means, such as welding, which screen 107 is adapted to stop birds or animals from entering the vent stack 26, while permitting airflow between the vent stack 26 and the outer atmosphere.

Figure 7:
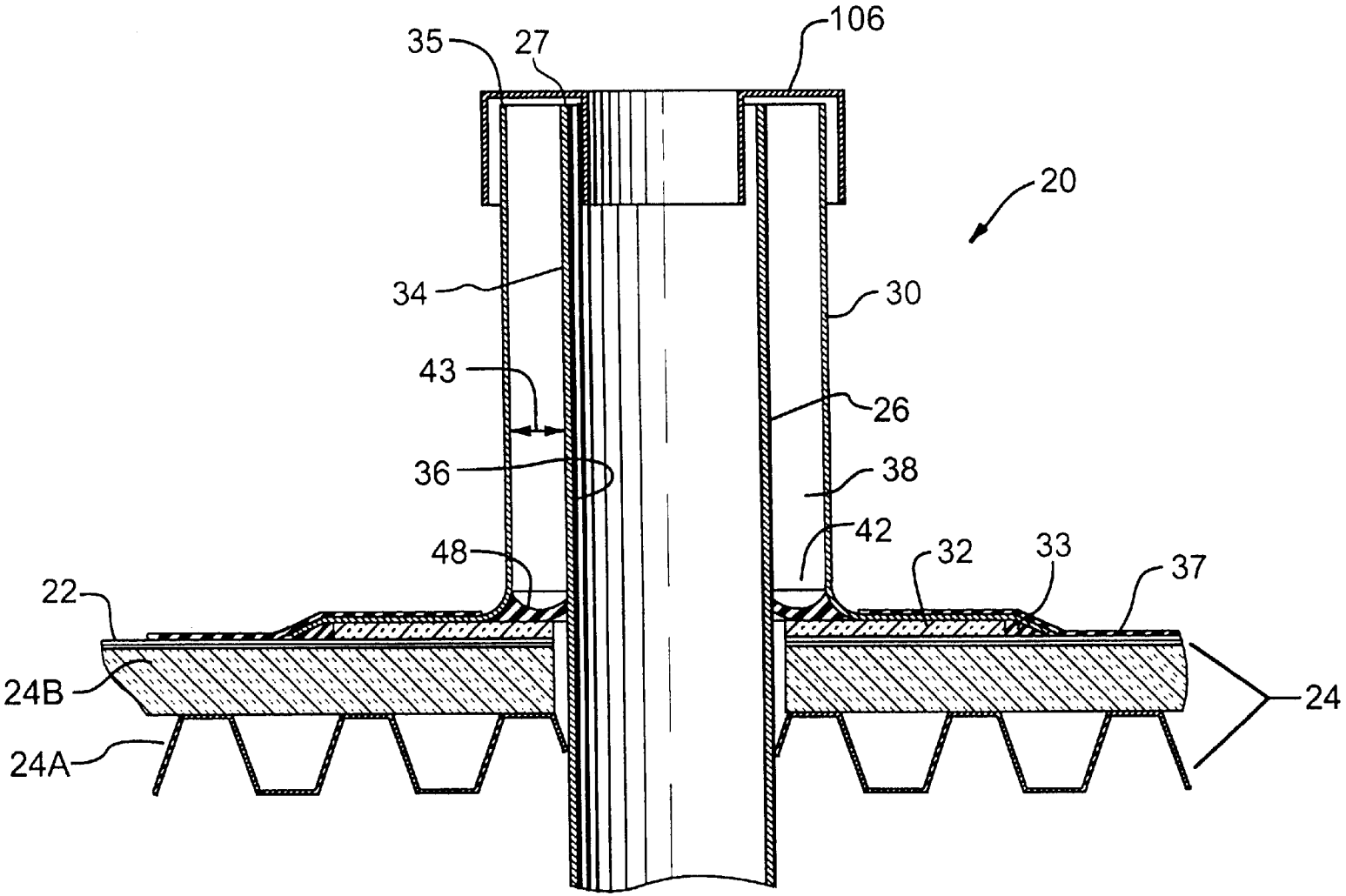
FIG. 7 is a sectional view showing a third embodiment of a roof flashing assembly according to the present invention.

In the alternative embodiment of FIG. 7, the roof flashing assembly further comprises a cap member 106 rigidly mounted by known mounting means, upon the upper end 35 of the boss portion 34 in capped overlying relation to said upper end 35, which cap member 106 is adapted to overly the projecting end 27 of the elongate member 26, when the base portion 32 is operatively mounted upon the roof surface 22. The body member 30 is preferably constructed with the boss portion 34 being annular, with the passageway 38 being substantially cylindrical, and with the base portion 32 being substantially annular and coaxial with the boss portion 34, and incorporating an annular resilient gasket 48 as the sealing means 48.

Although the above description and accompanying drawings relate to specific preferred embodiments of the present invention as presently contemplated by the inventor, it will be understood that various changes in size and shape of parts may be made without departing from the spirit of the invention.

I claim:

1. A roof flashing assembly for sealing between an upper roof surface of a roof structure and an elongate member of substantially constant cross-section axially extending substantially vertically upwardly above said roof surface to a projecting end of said elongate member, said assembly comprising, in combination:

a body member, comprising a base portion adapted to be rigidly sealingly mountable upon said roof surface in surrounding relation to said elongate member; and a boss portion axially extending from said base portion to an upper end of the boss portion, said boss portion having an inner boss surface, which inner boss surface defines an elongated passageway extending through the boss portion, which elongated passageway is adapted to receive therethrough said elongate member when the base portion is operatively mounted upon said roof surface wherein an elongated, interior gap is defined between said inner boss surface and an outer perimeter surface of said elongated member;

means for directing moisture away from a first end of said interior gap, said means disposed at a location axially spaced from the base portion, when the base portion is operatively mounted upon said roof surface; and sealing means disposed at a second end of said interior gap where said base portion extends from said boss portion for resiliently sealing from moisture said second end of said interior gap, when the base portion is operatively mounted upon said roof surface.

2. A roof flashing assembly according to claim 1, wherein the sealing means is a resilient gasket.

3. A roof flashing assembly according to claim 2, wherein the boss portion is annular, with the passageway defined by the inner boss surface being substantially cylindrical.

4. A roof flashing assembly according to claim 3, wherein the base portion is annular and is coaxial with the boss portion.

5. A roof flashing assembly for sealing between an upper roof surface of a roof structure and an elongate member of substantially constant cross-section axially extending substantially vertically upwardly above said roof surface to a projecting end of said elongate member, said assembly comprising, in combination:

a body member, comprising an annular base portion adapted to be rigidly sealingly mountable upon said roof surface in surrounding relating to said elongate member; and an annular boss portion axially extending from said base portion to an upper end of the boss portion, said boss portion having an inner boss surface, which inner boss surface defines a substantially cylindrical passageway extending through the boss portion, which passageway is adapted to receive therethrough said elongate member when the base portion is operatively mounted upon said roof surface;

means for directing moisture away from a first end of a gap defined between an outer perimeter surface of said elongate member and the inner boss surface, at a location axially spaced from the base portion, when the base portion is operatively mounted upon said roof surface; and a sealing means for resiliently sealing from moisture a second end of said gap at a location axially adjacent to the base portion, when the base portion is operatively mounted upon said roof surface, wherein the sealing means is an annular resilient gasket, having a substantially flat lower surface, with an inner perimeter and an outer perimeter thereof, and having circumferentially extending first, second and third upper surface contours, with the first contour defining a sealing surface which commences at the inner perimeter of the lower surface, and extends therefrom in an upwardly directed arc, first inwardly, thence outwardly, to a first terminus, which sealing surface is adapted to resiliently sealingly contact against said outer perimeter surface of said elongate member at said location axially adjacent said base portion, when the base portion is operatively mounted upon said roof surface, the second contour defining a concave body portion of the resilient gasket which commences at the first terminus, extends therefrom, initially, radially outwardly, thence, in an upwardly and outwardly directed arc, to a second terminus, and the third contour defining a mounting surface, commencing at the second terminus and extending in a downwardly and outwardly directed arc to the outer perimeter, which mounting surface is rigidly sealingly mounted to said inner boss surface.

6. A roof flashing assembly according to claim 5, wherein the resilient gasket is constructed of homogenous elastomeric material.

7. A roof flashing assembly according to claim 6, wherein the body member is constructed from spun metal.

8. A roof flashing assembly according to claim 7, wherein the body member is constructed from spun aluminum.

9. A roof flashing assembly according to claim 8, wherein the roof flashing assembly further comprises an annular flange portion positioned coaxially within the boss portion, adjacent said upper end of the boss portion so as to extend radially inwardly from the inner boss surface.

10. A body member according to claim 9, wherein the means for directing moisture away is a resilient grommet which comprises:

an annular grommet body, having a groove extending circumferentially around an outer base surface of the grommet body, and an interior grommet surface; and a sealing lip means positioned on said interior grommet surface, extending inwardly adjacent a top surface of the grommet body and being adapted to resiliently sealing receive said outer perimeter surface of the elongate member at said location axially spaced from the base portion, when the base portion is operatively mounted upon said roof surface, said grommet being assembled on said upper end of the boss portion with the groove in resilient sealing engagement with said annular flange portion.

11. A roof flashing assembly according to claim 10, wherein the sealing lip means comprises three inwardly tapered circumferentially extending lips, disposed in downwardly outwardly stepped relation coaxial with the boss portion, said lips having internal diameters of downwardly increasing magnitude.

12. A roof flashing assembly according to claim 11, wherein the resilient grommet is constructed of homogenous elastomeric material.

13. A roof flashing assembly according to claim 8, wherein the body member further comprises an insulating liner positioned within the passageway and being rigidly attached to the body member, said insulating liner having an axially aligned channel therethrough, adapted to receive said elongate member when the base portion is operatively mounted upon said roof surface.

14. A roof flashing assembly according to claim 13, wherein the insulating liner has a lower annular surface, which lower annular surface is rigidly sealingly attached to the concave body portion of the resilient gasket.

15. A roof flashing assembly according to claim 14, further comprising a cap member rigidly mounted upon the upper end of the boss portion in capped overlying relation to said upper end, which cap member is adapted to overly said projecting end of said elongate member when the base portion is operatively mounted upon said roof surface.

* * * * *